US005308027A

United States Patent [19]

Fullilove

[11] Patent Number: 5,308,027

[45] Date of Patent: May 3, 1994

[54] DUAL USE LEAF BAGGER

[76] Inventor: Tom P. Fullilove, P.O. Box 6063, Shreveport, La. 71136

[21] Appl. No.: 1,674

[22] Filed: Jan. 7, 1993

[51] Int. Cl.[5] ..... B65D 33/00

[52] U.S. Cl. ..... 248/101; 248/126; 248/99

[58] Field of Search ..... 248/99, 101, 95, 97, 248/156, 149, 126; 294/1.1, 55; 220/703, 628, 18; 383/12, 33

[56] References Cited

U.S. PATENT DOCUMENTS

| | | | |
|---|---|---|---|
| 4,357,728 | 11/1982 | Pravettone . | |
| 4,530,533 | 7/1985 | Dieter . | |
| 4,548,372 | 10/1985 | Lutzker | 248/99 |
| 4,550,440 | 10/1985 | Rico | 248/99 |
| 4,601,255 | 7/1986 | Marcotti . | |
| 4,705,246 | 11/1987 | Wolf . | |
| 4,757,966 | 7/1988 | Harris | 248/97 |
| 4,759,519 | 7/1988 | Cheng | 248/99 |
| 4,787,753 | 11/1988 | Barnhart . | |
| 4,832,291 | 5/1989 | Nelson et al. | 248/99 |
| 5,014,943 | 5/1991 | Nelson et al. | 248/99 |
| 5,050,920 | 9/1991 | Potticary | 294/1.1 X |
| 5,106,041 | 4/1992 | Jelincic | 248/99 |

FOREIGN PATENT DOCUMENTS

| | | | |
|---|---|---|---|
| 1289567 | 9/1972 | United Kingdom | 294/1.1 |

*Primary Examiner*—Karen J. Chotkowski

*Attorney, Agent, or Firm*—Oblon, Spivak, McClelland, Maier & Neustadt

[57] ABSTRACT

A leaf bagger composed of an adjustable planar frame carrying on a lower part. A plate is fixed to the lower frame part define front and rear ramps having front and rear edges extending beyond the lower frame part and lying in a common plane. The ramps thus serve to guide material, such as leaves, moved horizontally into a horizontally disposed bag whose mouth is received over the frame and the ramps also serve to support the frame in a vertical position. The plate defining the ramps also be hung vertically on a wall so that the frame is horizontal to receive trash deposited vertically into a bag now carried vertically by the frame.

7 Claims, 4 Drawing Sheets

FIG. 1
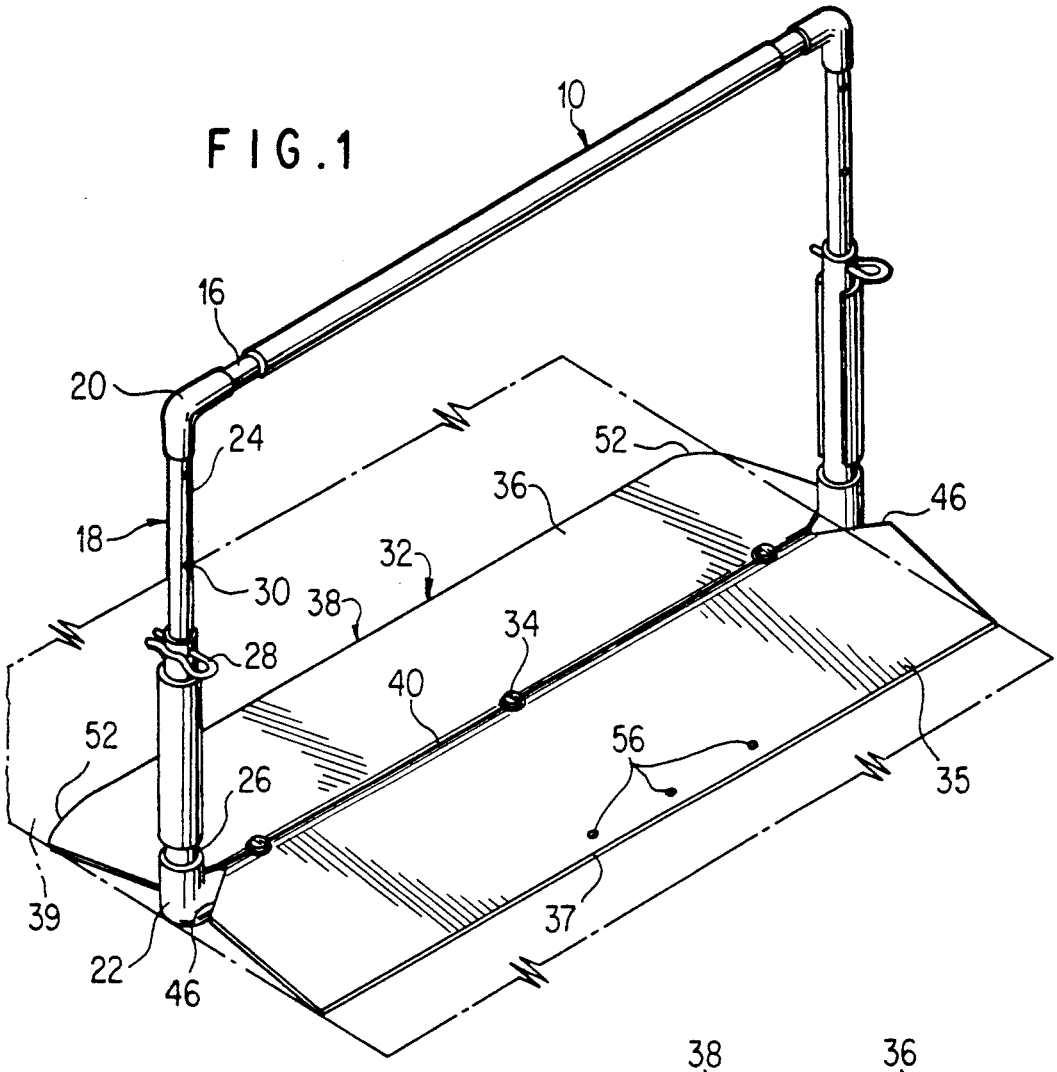
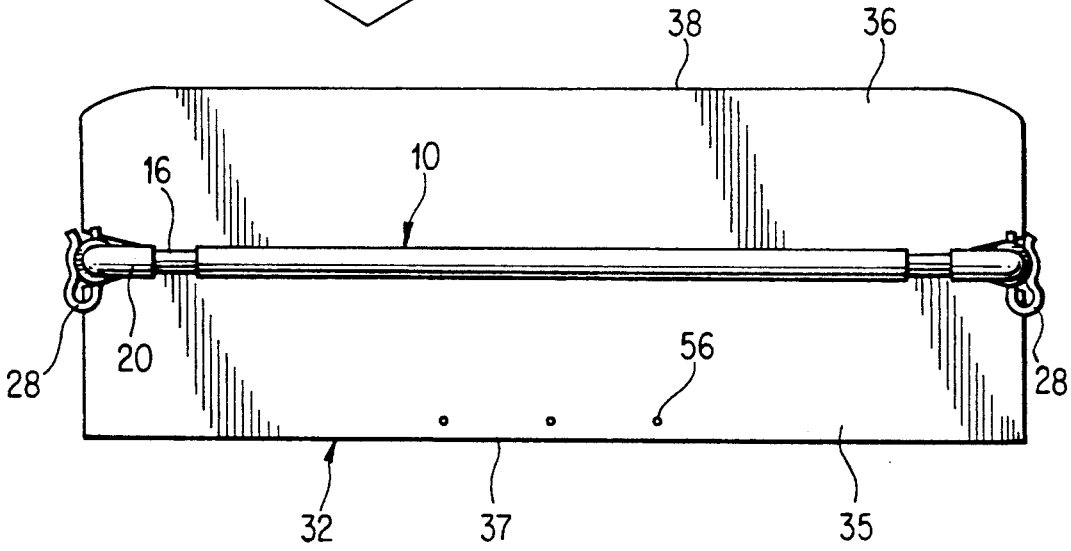
FIG. 2

37
56
54
35
28
58
22
48
34
10
20
40
38
36
28
54
52
50

DUAL USE LEAF BAGGER

FIELD OF THE INVENTION

This invention relates to leaf baggers and more particularly to a lightweight portable leaf bagger which is equally useable as a trash bag support.

BACKGROUND OF THE INVENTION

There are a number of prior patents for leaf baggers consisting of frames which can be inserted into the mouth of the plastic leaf bag to retain the bag open. A typical frame for this purpose is shown in the patent to Barnhart U.S. Pat. No. 4,787,753 where the bag mouth is first threaded through an inner frame then folded back over the frame with an outer frame trapping the folded-over part of the bag between it and the first frame. A major problem with this type of frame is that there is no means other than a user's hand for supporting the frame in a vertical position which is extremely awkward and inefficient when one tries to rake leaves into the bag with only one hand. Furthermore, bare bag material is located immediately inside the frame where it can be easily snagged and ripped by rake tines, particularly when the rake is under the control of only one hand.

Other baggers are either complex and thus exorbitantly expensive as, for example the wheeled bagger shown in the patent to Pravettone U.S. Pat. No. 4,357,728, or lack ramps while exposing the bag to damage as in the patent to Wolf U.S. Pat. No. 4,704,246, or have parts which are easily struck by the rake as in Dieter U.S. Pat. No. 4,530,533.

Furthermore, little thought has been given to making use of the baggers for collecting trash in that long period of the year between leaf falls.

SUMMARY OF THE INVENTION

The object of the present invention is to provide an inexpensive, lightweight easily portable leaf bagger which is capable of standing by itself to provide an outer ramp onto which the leaves are raked and an inner ramp which extends sufficiently far into the bag to protect that part of the bag most vulnerable to ripping by a rake.

Another object to the invention is to provide a leaf bagger which is readily adjustable to permit the use, for example, of relatively small bags, e.g. so-called standard trash bags used to line garbage cans up to large conventional leaf bags.

Still another very important object of the invention is to provide a leaf bagger which is so constructed as to enable its use with either horizontally or vertically disposed bags.

BRIEF DESCRIPTION OF THE DRAWINGS

FIG. 1 is a perspective view of the leaf bagger of the invention;

FIG. 2 is a top plan view of the bagger;

DETAILED DESCRIPTION OF THE INVENTION

Figure 3:
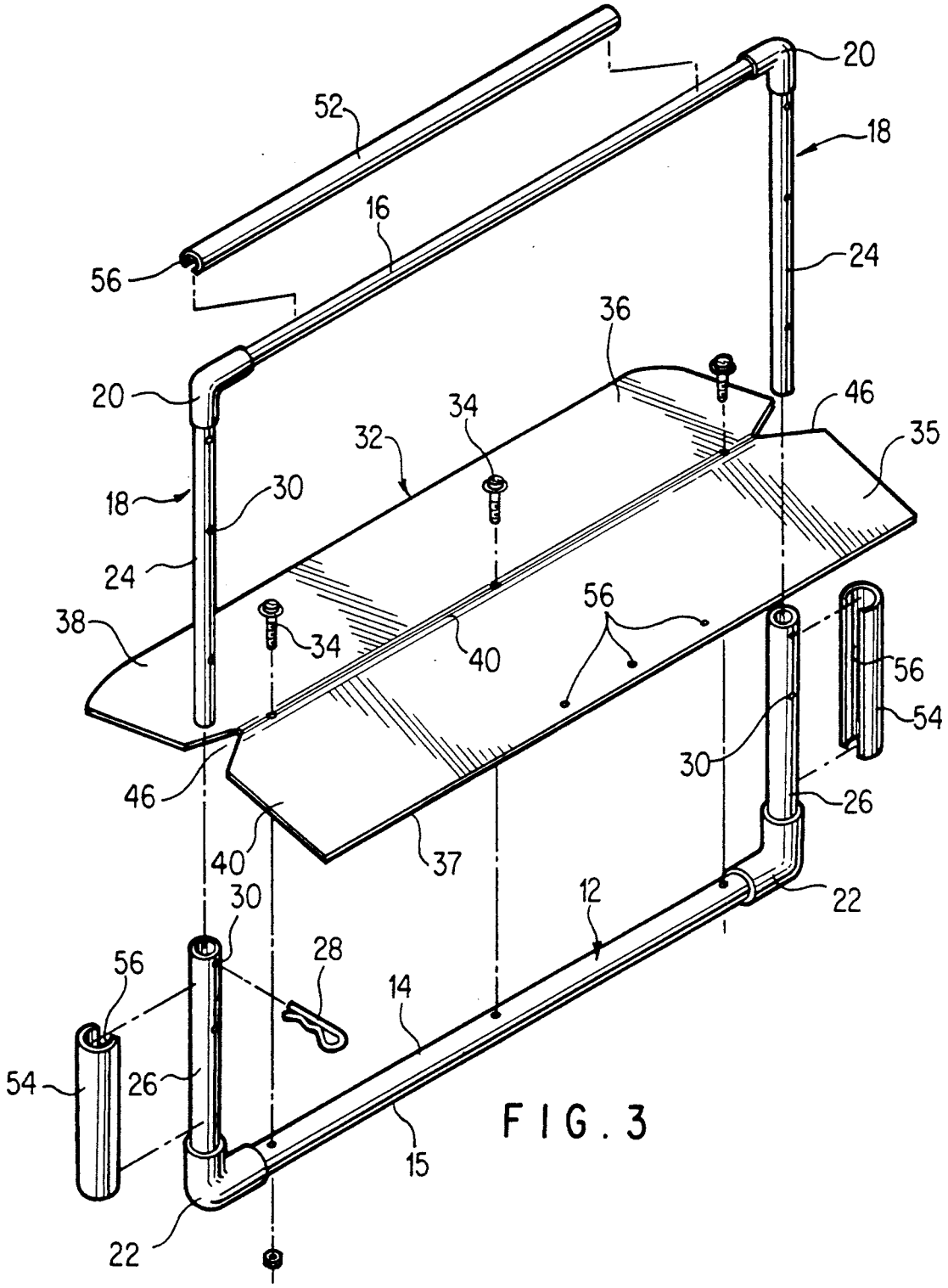
FIG. 3 is an exploded perspective view of the bagger of the invention.

Turning now to the drawings and particularly FIGS. 1, 2 and 3, the leaf bagger of the invention comprises a closed planar frame 10 which is preferably rectangular in shape though it could have any other polygonal shape, or even be partly circular. Conveniently the frame can be fabricated of polyvinyl chloride pipe available in plumbing supply houses and comprises a laterally extending straight lower part 12, best seen in FIG. 3, having an upper and lower surfaces 14, 15 lying in the plane of the frame, an upper part 16 spaced from the lower part 12 and laterally spaced side parts or legs broadly designated by the numerals 18. The parts of the frame may be joined together at the corners by conventional elbows 20 and 22 as is customary in plumbing with plastic pipe. In order to simplify the description, the invention will be described as if the frame were in a vertical plane wherein parts may be referred to as "upper" or "lower". As will become apparent, the frame has equal facility in a horizontal plane were parts might be referred to as "inner" or "outer". It is believed a reader will have no problem in making this change mentally when the unit is described in its horizontal use.

The frame is desirably rectangular since this permits the ready adjustment of its size to conform to that of a bag. As shown, the legs 18 may be constructed in two telescoping parts 24, 26, as best seen in FIG. 3, with first upper leg parts 24 being fixed to the upper frame part 16 and second lower leg parts 26 being fixed to the lower frame part 12. The leg parts have releasable fastening means for retaining the telescoping leg parts in selected position with respect to each other. Advantageously, the retaining means may comprise spring type cotter pins 28 engageable with selectively alignable holes 30 in the respective leg parts 24, 26.

In accordance with the invention an elongated support plate 32 is centrally connected substantially perpendicular to the plane of the frame 10 by means such as screws 34 to the upper surface 14 of the lower frame part 12. The plate has a width defining first and second parts 35, 36 having front and rear outer edges 37, 38 parallel to the axis of the lower frame part and extending on opposite sides of the plane of the frame 10 distances such that the edges 37, 38 comprise stable support means for engaging a supporting surface, either horizontal or vertical, perpendicular to the plane of the frame. Each of the edges lies in a common plane, designated by the numeral 39 in FIG. 1, substantially normal to the plane of frame 10 with the plane 39 preferably not extending above the lower surface 15 of the lower part 12 of the frame, which is to say, the edges 36, 38 desirably define the sole support for the frame when in an upright position of use. So long as the plane 39 of the edges 37, 38 does not intersect the lower surface 15 of the lower frame part 12, then the lower surface cannot provide any or sufficient engagement with the ground to permit the frame to rock annoyingly about the lower surface 15 of the lower frame part 12.

In addition to providing support for the frame 10 as above described, it will be apparent that the plate 32 must be bent along a line 40 (FIG. 1), the lower face of which engages the upper surface 14 of the lower frame part 12. Thus the plate parts 35, 36 defines front and rear ramps 42, 44 sloping upwardly and downwardly over the lower frame part 12. It is not essential that the ramps be symmetrical on either side of the lower frame member so long as their edges 37, 38 extend beyond the lower frame part 12 to provide ramps and upright support for the frame 10 when it is in a position of use for receiving material moved there towards generally horizontally. Desirably, the ends of the plate 32 are symmetrically notched as shown at 46 on either side of the bend line 40 to accommodate the legs 18 and to ensure that the ramps 35, 36, have lateral dimensions substantially equal to the width of the frame 10.

Figure 4:
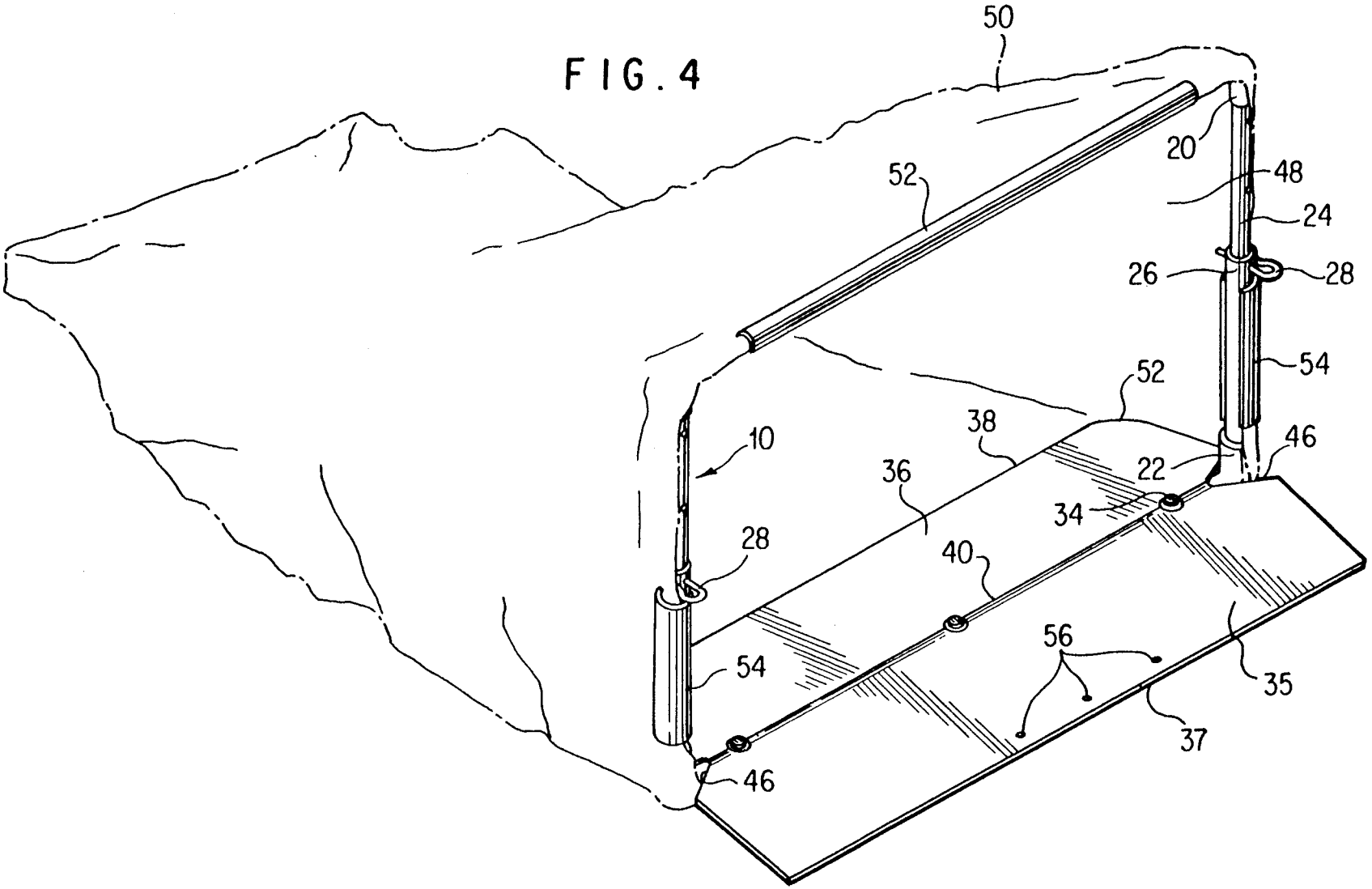
FIG. 4 is a perspective view showing the bagger with a leaf bag attached thereto in a horizontal position to receive raked leaves.

In use of the invention for directing material such as leaves into the bag when the material is moved horizontally, as by a rake, and with reference to FIG. 4, the open end 48 of a bag 50, which may be a plastic leaf bag, is moved over the frame 10 and in so doing the lower part of the open end of the bag is moved under the inner ramp 36, the latter being of a size to be entirely received within the bag. To facilitate insertion of the ramp 36 into the bag and to protect the bag from being ripped, the corners 52 of the ramp 36 are rounded as shown. After the bag has been properly positioned over the frame 10 the open end of the bag is clamped to the frame. In accordance with the invention, where the frame parts are circular in cross section, a clamp or clamps may comprise lengths 52, 54 of resilient pipe, preferably PVC, as best seen in FIG. 3. The pipe lengths 52, 54 are slit from end to end by removing therefrom narrow strips as shown at 56, with the lengths having internal diameters slightly less than the external diameters of the respective frame parts, which is to say, each pipe length could be of the same cross sectional size as the frame parts whereby the internal diameters of the clamps would automatically be slightly less than the diameters of the frame parts, thus enabling the clamps to be manually spread open and snapped over the frame parts into tight clamping engagement therewith, trapping the bag material between the clamps and frame parts. An advantage of this type of clamp is that it protects the bag material where it engages the frame against damage from a rake as it is swung toward and partly into the open end of the bag during leaf raking.

Figure 5:
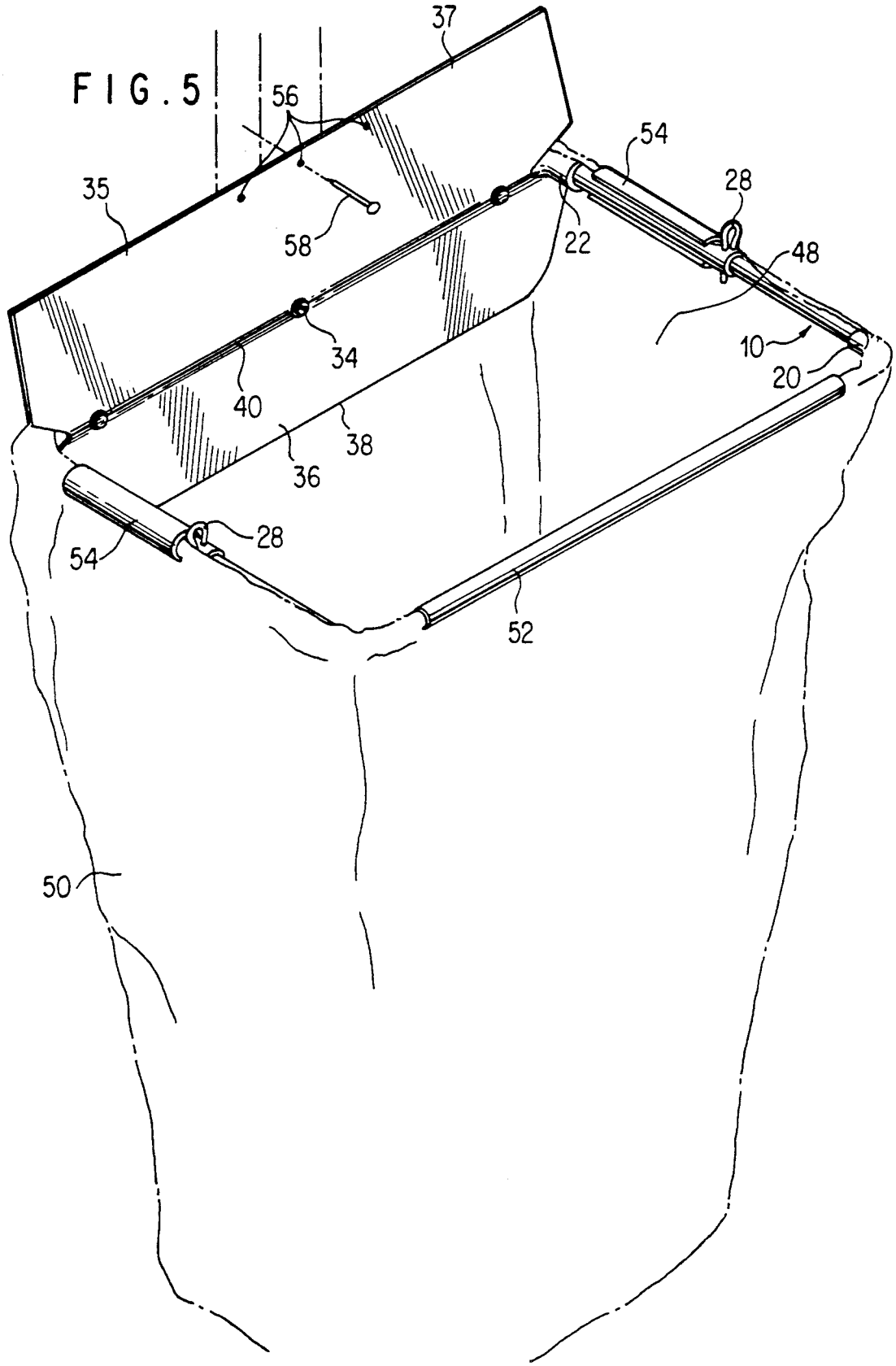
FIG. 5 is a perspective view showing the bagger with a bag attached but with the bagger hung horizontally to a wall with the bag in a vertical position to receive trash or the like deposited vertically into the bag.

An especially valuable feature of the invention resides in the provision of means permitting the frame 10 in a 10 with a bag attached thereto to be hung relative to a vertical wall with the frame horizontal as illustrated in FIG. 5. The hanging means preferably comprises at least one aperture 56 adjacent the front edge 37 of the front ramp 35 midway between the ends thereof. The one or more apertures 56 are arranged for engagement with a support generally represented by the nail 58 in FIG. 5. Obviously instead of a nail, the support means could be a single hook or a pair of laterally spaced hooks to restrain the unit from rocking. The great advantage of this capability is that between annual leaf raking sessions, the frame with bag attached can be hung in any space, for example, the garage or basement into which trash can be easily thrown. The size of the frame can be adjusted to match that of the standard garbage can liner which is smaller and stronger than the conventional leaf bag. Should the material thrown into the bag be heavy, the support elements 58 could be located on a wall in a position enabling the bottom of the bag to rest on the floor. It will be apparent, of course, that when not used for raking leaves, the unit with bag attached can be placed vertically with the bag horizontal on a floor, say a basement floor covered with saw dust, whereupon the saw dust can be easily swept into the bag after which the unit and the partially filled, bag can be hung horizontally on the wall as in FIG. 5 with the bag vertical to receive other debris. Wherever the unit is used, it is easily picked up by grasping the upper frame part 16 and transporting the frame with bag attached from place to place as required.

It is within the purview of the invention for the lateral sides of the front ramp 35 to diverge outwardly, and/or be provided with upstanding side flanges to aid in funneling material into the bag whether the frame is in its vertical or horizontal position of use. Though PVC pipe has been found suitable for its strength, weight and ease of fabrication, the invention can obviously be constructed of any other suitable material such as aluminum tubing, flat metal or the like. Though the lower plate 32 has been shown and described as being a separate element fastened to the upper surface 14 of the lower frame member 12, it is within the purview of the invention for the plate 32 to constitute the sole lower frame member with means being provided for permanently or releasably fixing the opposite ends of the plate to the lower ends of the side legs of the frame. Though it is desirable that the ramps parts 35, 36 slope in opposite direction relative to the central bend line 40, the plate could be flat or substantially flat, particularly where it constitutes the sole lower frame member. Thus, first and second parts in the claims should be construed to means inner and outer flanges, flat or sloping, extending to either side of the plane of the frame.

From the foregoing it will be apparent that the invention is susceptible of a variety of changes and modification without however, departing from the scope and spirit of the appended claims.

I claim:

1. A leaf bagger comprising a planar frame including a pair of laterally spaced legs having first and second ends, a cross member interconnecting the first ends of said legs to define an outer portion of said frame, a support plate, and means for releasably connecting said support plate between said second ends of said legs substantially perpendicular to the plane of said frame, said plate having a width defining first and second parts having outer edges extending on opposite sides of the plane of said frame distances such that said edges comprise stable support means for engaging a supporting surface perpendicular to the plane of said frame, said frame being of a size to receive thereover the open end of a flexible refuse bag, said first part of said plate being of a size to be entirely received in the open end of a bag to overlie the inner surface thereof from said outer edge of said first plate part to said frame to serve as a protective guide for directing material into a bag received on said frame.

2. The leaf bagger of claim 1 including at least one clamp for releasably connecting a leaf bag adjacent its open end to at least one part of said frame, said at least one frame part being circular in cross section and said at least one clamp comprising a length of pipe not greater than the length of said one frame part, of resilient material and slit from end to end, the internal diameter of said pipe being slightly less than the external diameter of said at least one frame part but of a size enabling said pipe section to be spread and then snapped over said frame part into tight clamping engagement therewith.

3. The leaf bagger of claim 2 wherein said length of pipe is plastic.

4. The leaf bagger of claim 1 including means carried by the second part of said plate for hanging said plate on a vertical surface with said frame disposed in a horizontal position, said hanging means being disposed on said second part of said plate in a position which is entirely clear of a bag when received on said frame.

5. The leaf bagger of claim 4 wherein said hanging means comprises at least one aperture adjacent an outer edge of said second part of said plate midway between the ends thereof, said aperture being arranged for engagement with a supporting element fixed with respect to said vertical surface.

6. The leaf bagger of claim 1 wherein said legs have a length which is adjustable.

7. The leaf bagger of claim 1 wherein said first and second parts of said plate have laterally spaced outer corners, the corners of at least said first part being rounded.

* * * * *